US006407657B1

(12) United States Patent
Oh

(10) Patent No.: US 6,407,657 B1
(45) Date of Patent: Jun. 18, 2002

(54) DUAL USE FUSE

(75) Inventor: Seibang Oh, Elk Grove Village, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 09/497,039

(22) Filed: Feb. 3, 2000

(51) Int. Cl.[7] ..... H01H 85/153; H01H 85/143; H01R 12/30; H01R 13/04

(52) U.S. Cl. ..... 337/197; 337/198; 337/181; 439/176; 439/830; 439/890

(58) Field of Search ..... 337/197, 198, 337/186, 166, 180, 181; 29/623; 439/176, 221, 775, 830, 832, 834, 838, 839, 843, 845, 849, 883, 850, 890, 891

(56) References Cited

U.S. PATENT DOCUMENTS

| | | | | | |
|---|---|---|---|---|---|
| 2,061,961 | A | * | 11/1936 | Culver et al. | 439/742 |
| 3,909,767 | A | | 9/1975 | Williamson et al. | |
| 4,023,265 | A | | 5/1977 | Aryamane | |
| 4,118,682 | A | * | 10/1978 | Lange et al. | 337/34 |
| 4,131,869 | A | | 12/1978 | Schmidt, Jr. et al. | |
| 4,570,147 | A | * | 2/1986 | Ebi | 337/166 |
| 4,580,124 | A | | 4/1986 | Borzoni | |
| 4,604,602 | A | | 8/1986 | Borzoni | |
| 4,635,023 | A | | 1/1987 | Oh | |
| 4,661,793 | A | | 4/1987 | Borzoni | |
| 4,751,490 | A | * | 6/1988 | Hatagishi | 337/295 |
| 4,800,358 | A | * | 1/1989 | Takenouchi et al. | 337/268 |
| 4,869,972 | A | * | 9/1989 | Hatagishi | 428/647 |
| 4,871,990 | A | * | 10/1989 | Ikeda et al. | 337/238 |
| 4,997,393 | A | | 3/1991 | Armando | |
| 5,139,443 | A | * | 8/1992 | Armando | 439/620 |
| 5,227,759 | A | * | 7/1993 | Hatagishi | 337/260 |
| 5,229,739 | A | | 7/1993 | Oh et al. | |
| 5,340,337 | A | * | 8/1994 | Pentz | 439/843 |
| 5,555,153 | A | * | 9/1996 | Frederiksen | 361/119 |
| 5,581,225 | A | * | 12/1996 | Oh et al. | 337/295 |
| 5,631,619 | A | * | 5/1997 | Evans | 337/198 |
| 5,663,861 | A | | 9/1997 | Reddy et al. | |
| 5,668,521 | A | | 9/1997 | Oh | |
| 5,736,920 | A | * | 4/1998 | Evans et al. | 337/290 |
| 5,739,739 | A | * | 4/1998 | Muramatsu et al. | 337/234 |
| 5,816,858 | A | * | 10/1998 | Kazarian et al. | 439/621 |

FOREIGN PATENT DOCUMENTS

| | | | | |
|---|---|---|---|---|
| EP | 0127353 | * | 12/1984 | H01R/13/66 |

* cited by examiner

*Primary Examiner*—Anatoly Vortman
(74) *Attorney, Agent, or Firm*—Bell, Boyd & Lloyd LLC

(57) ABSTRACT

A metallic element for use with a blade fuse or other electrical component, and a blade fuse or other electrical component that includes that metallic element as one of its components. The fuse maybe mounted in a fuseholder having either male terminal receiving clips, or female terminal receiving clips. The metallic element includes two terminal portions, each made of a first prong and a second prong. The second prong is spaced apart from the first prong, and a fusible link is secured to each of the two terminal portions. The spaced apart first and second prongs together form a gap between them to ensure secure engagement of the first and second prongs with male terminal blade-receiving clips.

23 Claims, 7 Drawing Sheets

DUAL USE FUSE

TECHNICAL FIELD

The invention relates to a novel fuse and a metallic element for that fuse. The fuse can be used in fuseholders having either male or female terminal receiving clips.

BACKGROUND OF THE INVENTION

Conventional blade fuses are well-known in the art. The modern electrical blade fuse was perfected by Littelfuse, Inc., the assignee of the present invention, and was described in many patents by the assignee. These patents include, but are not limited to, Littelfuse's U.S. Pat. Nos. 3,909,767; 4,023,265; 4,131,869; 4,580,124; 4,604,602; 4,635,023; 4,661,793; 4,997,393; 5,139,443; 5,663,861; and 5,668,521.

Some of fuses described in these patents include either a V-shaped or a sinusoidal-shaped fuse link. One example of such a V-shaped fuse link is that shown in U.S. Pat. No. 4,131,869. The V-shaped fuse link is shown as item 20 in FIG. 13 of the '869 patent, and is described at column 6, line 56, through column 7, line 18 of the '869 patent.

As is well-known in the art, blade fuses of the types shown in the above-referenced patents protect electrical circuits from anomalies such as current overloads. This protection results, for example, from the creation of a short in the fuse, and therefore in the circuit protected by the fuse, upon certain current overload conditions. Particularly, the fuse link breaks or opens upon current overload over a predetermined length of time.

Currently, blade fuses include male type terminals. Such male type terminals are shown as item 16 in FIG. 1 of U.S. Pat. No. 4,560,227 ("the '227 patent), which is assigned to the assignee of the present invention. These male-type terminals are inserted into the corresponding female terminal-receiving clips 24 of a fuseholder unit 10, as shown in FIGS. 1 and 2A of the '227 patent.

The blade fuses shown in the '227 patent have been satisfactorily used throughout the world for nearly thirty years. There is, however, a desire to overcome certain design deficiencies of fuseholders having such female terminal-receiving clips.

First, these female terminal-receiving clips include moving parts. For example, the receiving clips have parallel planar elements that are closely spaced apart from each other. The spacing of these planar elements is less than the thickness of the male terminals which the elements receive. Thus, when the male terminals enter the receiving clips, the parallel planar elements, which are biased towards each other by spring-like components, move outwardly away from each other. This structure ensures that the receiving clips tightly and securely grip the male terminals. However, like all structures with moving parts, this structure is also subject to wear. In particular, the springs which bias the planar elements can lose their resiliency, and thus their effectiveness in biasing the planar elements toward each other. If this happens, the two inadequately biased receiving clips may be incapable of securely holding the male terminals. This in turn compromises the electrical contact between the two receiving clips and the male terminal received by those clips.

Second, the structure of female terminal receiving clips makes them inherently more susceptible to damage from electrical problems arising in the circuits which their fuses protect. When severe damage occurs, it is necessary to either replace the receiving clips or replace the fuseholder. Because most fuseholders do not provide for easy removal of the female terminal receiving clips, the first of these two options is difficult, and requires the employment of skilled technicians. Because fuseholders are costly and because their replacement generally also requires the employment of a technician, the second option is relatively expensive.

There are certain types of fuses, other than blade fuses, that have female terminals. Examples are those fuses shown in U.S. Pat. Nos. 5,581,225, 4,570,147; 4,751,490; 4,869,972; and 4,871,990. Such fuses, however, are somewhat complex in structure, and thus somewhat expensive to manufacture.

In addition, these fuses are not blade fuses, and are not useful in fuseholders with female terminal receiving clips.

It would be advantageous to design a fuse that avoids these deficiencies and problems.

SUMMARY OF THE INVENTION

The invention is a metallic element for a fuse, and a blade fuse that includes that metallic element. Like typical blade fuses, this blade fuse may be mounted in a fuseholder. Unlike typical blade fuses, this fuse may be mounted in a fuseholder having either male terminal receiving clips or female terminal receiving clips.

The metallic element includes two terminal portions, also simply known as terminals. Each of these terminal portions are made of a first prong and a second prong. In fact, as will be seen in the accompanying FIGURES, two of the three portions of the preferred embodiment of the metallic element of the invention look somewhat like a tuning fork. As with a tuning fork, the second prong is spaced apart from the first prong. Completing the metallic element is a fusible link that is secured to each of the two terminal portions.

In the metallic element of the invention, a gap is formed between the spaced apart first and second prongs. This gap is shaped and sized in a manner that will ensure secure engagement of the first and second prongs with male terminal blade-receiving clips.

The metallic element of the invention is formed in a manner that results in a fuse that is a dual use fuse. What this means is that the resulting fuse can be used with fuseholders having either male or female terminal receiving clips. When inserted into a fuseholder having a female terminal receiving clip, the first and second prongs of each of the terminal portions cooperatively fit into a corresponding female terminal receiving clip. In contrast, when inserted into a fuseholder having a male terminal receiving clip, the gap between the first and second prongs of each of the terminal portions of the metallic element tightly engage the male terminal receiving clip of the fuseholder.

Preferably, to provide adequate strength, the terminal portions of the metallic element are made of a copper alloy. It is also preferable that the metallic element is made up of three separate pieces, i.e., the two terminals and the fusible link. There are many advantages to the present invention. First, as suggested above, the construction of the invention allows it to be used with fuseblocks having either male or female terminal receiving clips.

Second, when the invention is used with fuseblocks having male terminal receiving clips, the female portion of the novel blade fuse terminal is used. In this way, if the female terminal is damaged due to electrical problems in the circuit being protected by the fuse, the replacement of the female terminal can be simply accommodated by replacement of the blade fuse, rather than by replacement of the terminal receiving clips.

Third, although there are several different types of fuses with female terminals, including the fuses described in U.S. Pat. Nos. 5,581,225, 4,570,147; 4,751,490; 4,869,972; and 4,871,990, their construction is much more complex and costly than the construction of the fuse of the present invention. Fourth, unlike the present invention, these prior art fuses with female terminals are not dual use fuses, i.e., they are not adaptable for use with fuseholders having both male and female terminal receiving clips.

DETAILED DESCRIPTION

While this invention may be made in many different embodiments, the drawings and specification describe in detail preferred embodiments of the invention. It should be understood that the present disclosure is to be considered an example of the principles of the invention. The disclosure is not intended to limit the broad aspect of the invention to the illustrated embodiments.

Figure 1:
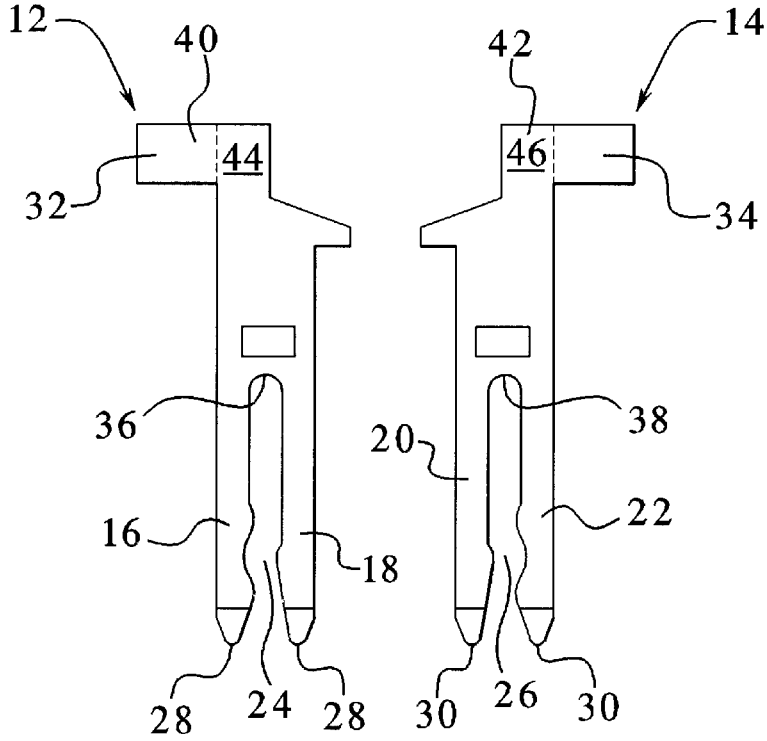
FIG. 1 is a perspective view of a pair of terminal portions that make up a part of the metallic element of the invention, and showing the first and second prong of each of those terminal portions.
Figure 2:
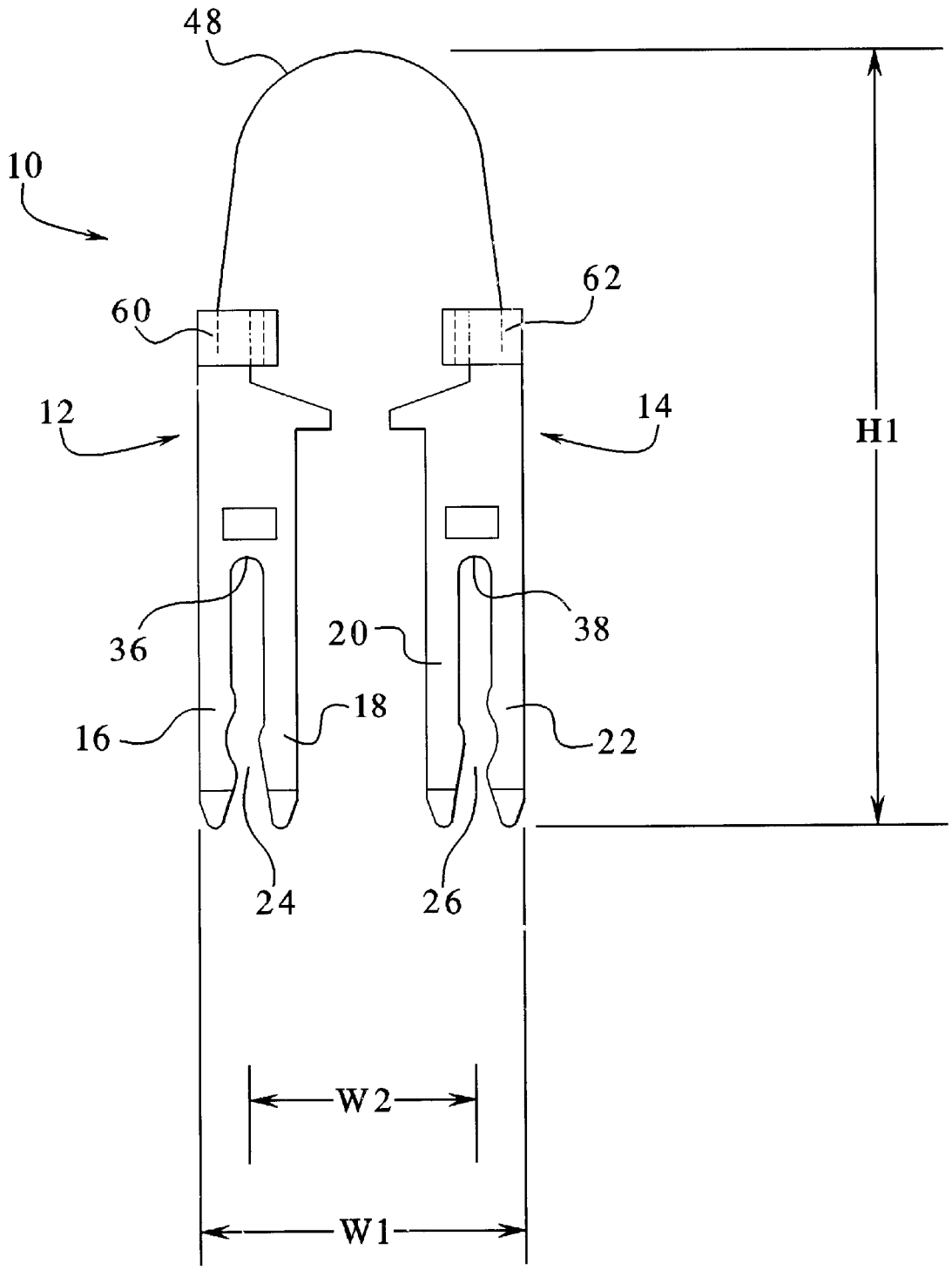
FIG. 2 is a perspective view of a complete metallic element of the invention, showing the terminals of FIG. 1 secured to a fusible link.

The invention is both a metallic element for use with a blade fuse, and a blade fuse which includes that metallic element as one of its components. Like typical blade fuses, this novel blade fuse may be mounted in a conventional fuseholder having female terminal receiving clips. Unlike typical blade fuses, however, this fuse may also be mounted in a fuseholder having male terminal receiving clips. The terminal portions of the metallic element 10 are shown in FIG. 1, and the entire metallic element 10 including the fusible link is shown in FIG. 2 of the drawings.

One aspect of the metallic element 10 of the present invention (FIG. 2) is superficially similar to the metallic elements of most blade fuses. In particular, the metallic element 10 of the present invention includes two terminal portions 12 and 14. These terminal portions 12 and 14 are shown alone and apart from each other in FIG. 1. In this embodiment, these terminals 12 and 14 are two separate pieces. However, the terminals 12 and 14 could also be of a single piece.

Prior art blade fuses have smooth, flat, uninterrupted terminals. Such terminal blades are shown as two items, numbered 8 in FIG. 1, of U.S. Pat. No. 4,023,265, which is incorporated herein by reference. Such terminal blades 8 are only insertable into fuseholders having female terminal receiving clips.

This contrasts with the terminals 12 and 14 of the present invention. As shown in FIGS. 1 and 2, each of these terminal portions 12 and 14 are made of a first prong 16, 20 and a second prong 18, 22, respectively. In fact, as may best be seen in FIGS. 1 and 2, each of the terminals 12 and 14 of the preferred embodiment of the metallic element 10 of the invention look somewhat like an inverted tuning fork.

As with a tuning fork, the second prongs of the terminals 18, 22 are spaced apart from the first prongs 16, 20. A gap 24 is formed between the first 16 and second prongs 18 of the terminal 12. An identical gap 26 is formed between the first 20 and second 22 prongs of the terminal 14. These gaps 24 and 26 are of a generally irregular shape, as seen in FIG. 1. More particularly, these gaps 24 and 26 are shaped and sized in a manner that will ensure secure engagement of the first 16, 20 and second prongs 18, 22 with male terminal blade-receiving clips in a fuseholder.

To ease insertion into a fuseholder having female terminal blade receiving clips, a pair of tapered ends 28 and 30 are provided at the two lower distal ends of the terminal portions 12 and 14, respectively.

The thickness of the metal used for the metallic element 10 is typical of the thicknesses of the conventional one-piece metallic elements of prior art blade fuses. For example, in one preferred embodiment of the present invention, the thickness of the metallic element 10 is 0.032 inch (0.81 mm). The height of the terminal portions 12 and 14, from the tip of the tapered ends 28 and 30 to the tops 36 and 38, or highest points, of the gaps 24 and 26, is approximately 0.295 inch (7.49 mm). As may be seen in FIG. 2, the height H1 of the metallic element 10 is slightly less than 0.869 inch (22.06 mm), and its width W1 is approximately 0.366 inch (9.29 mm). The width W2 from the vertical centers of the gaps 24 and 26 is 0.256 inch (6.5 mm).

As may be seen in FIG. 1, at the top of the terminals 12 and 14 are a pair of integral flaps 32 and 34, respectively. Because of the small thickness of the metallic element 10, these flaps 32 and 34 can be easily folded along dashed lines 40 and 42, respectively. In this embodiment, these flaps 32 and 34 are folded inwardly 180° along these dashed lines 40 and 42. When these flaps 32 and 34 are so folded, they face and abut tightly against the tops 44 and 46 of the terminals 12 and 14, respectively.

Figure 3:
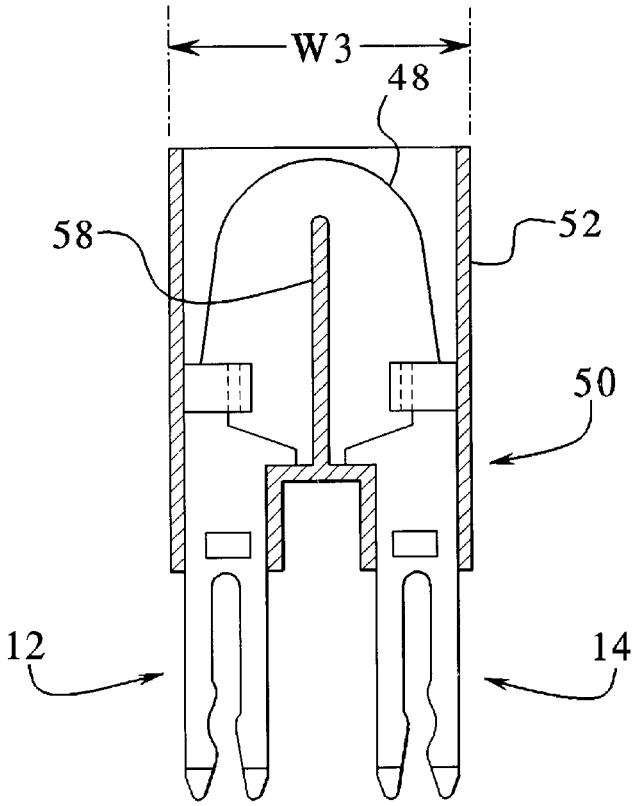
FIG. 3 is a perspective view of a blade fuse in accordance with the invention, combining the metallic element of FIG. 2 with a housing, which housing is shown partially and in cross section.

These flaps 32 and 34 are shown, in their 180° inwardly folded configuration, in FIGS. 2 and 3. When those flaps 32 and 34 are folded inwardly 180° along those dashed lines 40 and 42, the flaps trap the opposite ends of the fusible link 48. A secure mechanical and electrical connection is created by the tight entrapment of the ends of the fusible link 48 between the tops of the terminals 44 and 46 and the flaps 32 and 34.

Figure 1A:
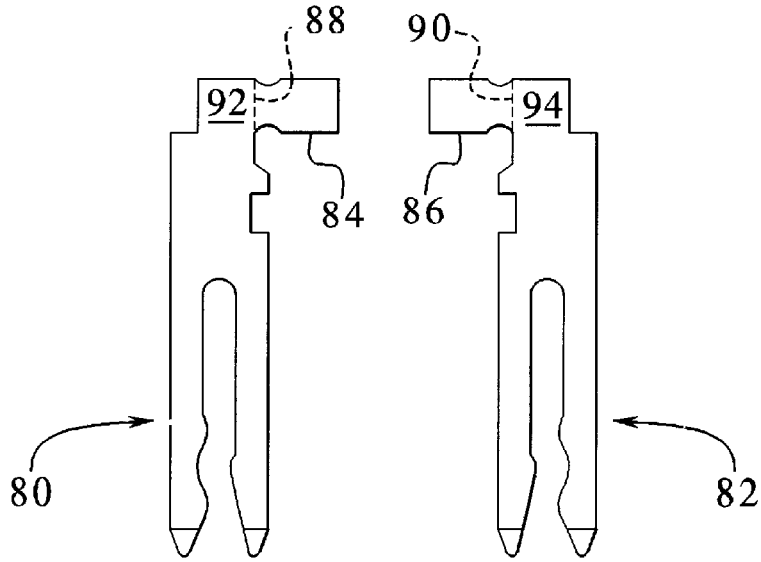
FIG. 1A is a perspective view of an alternative, slightly different embodiment of a pair of terminal portions that make up a part of the metallic element of the invention.

Alternatively, as may be seen in FIG. 1A, the tops of the terminals 80 and 82 may have a slightly different configuration. Particularly, at the top of the terminals 80 and 82 are a pair of integral flaps 84 and 86, respectively. Like the flaps of the embodiment of FIG. 1, these flaps 84 and 86 can also be easily folded, here along dashed lines 88 and 90, respectively. In this embodiment, these flaps 84 and 86 are folded outwardly 180° along these dashed lines 88 and 90. When these flaps 84 and 86 are so folded, they face and abut tightly against the tops 92 and 94 of the terminals 80 and 82, respectively.

Figure 7:
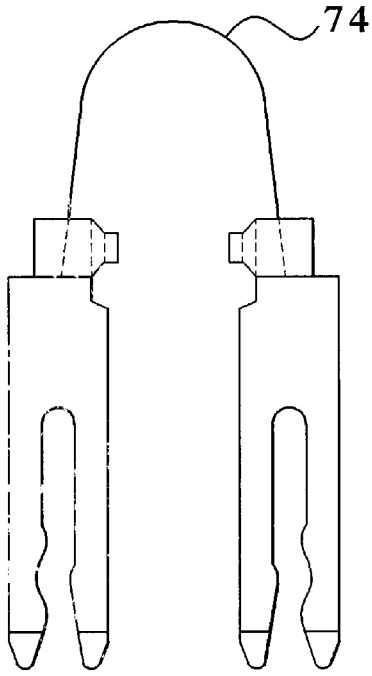
FIG. 7 is a perspective view of an alternative metallic element in accordance with the invention, showing a spiral-wound fusible link.
Figure 8:
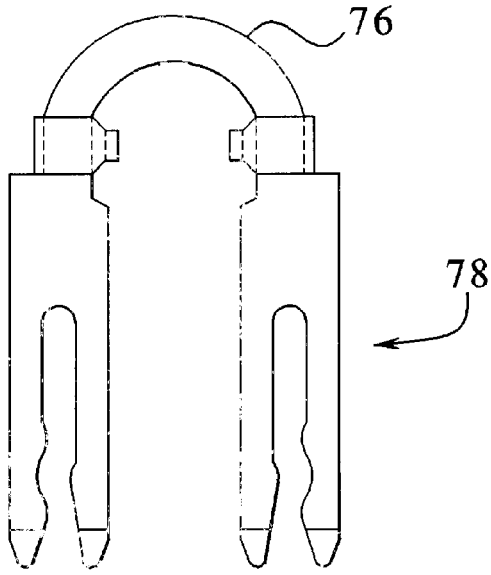
FIG. 8 is a perspective view of an alternative metallic element in accordance with the invention, showing a stamped element fusible link.

These flaps 84 and 86 are shown, in their 180° outwardly folded configuration, in the metallic elements of FIGS. 7 and 8. When those flaps 84 and 86 are folded outwardly 180° along those dashed lines 88 and 90, the flaps trap the opposite ends of the fusible links 74 and 76, respectively. A secure mechanical and electrical connection is created by the tight entrapment of the ends of the fusible links 74 and 76 between the tops of the terminals 80 and 82 and the flaps 84 and 86. This outwardly folding embodiment of FIG. 1A, with flaps 84 and 86, is preferred to the inwardly folding embodiment of FIG. 1, with flaps 32 and 34. One reason why the embodiment of FIG. 1A is preferred is that the terminals 80 and 82 can be made of less material and with less waste than the terminals 12 and 14.

Referring again to FIGS. 1–3, the fusible link 48 may be of the same or of a different metal than the terminals 12 and 14. The fusible link 48 shown in FIGS. 2 and 3 is of a thin, cylindrical cross-section. However, it will be understood by those skilled in the art that the fusible link 48 can be made of any material, or of any configuration, suitable for such fusible links 48.

For example, as may be seen in FIG. 7, the fusible link 74 may be made of a spiral-wound configuration. In this embodiment, the fusible link 74 for a 7½ ampere-rated fuse is made of 0.004 inch diameter TOPHET "C" wire at its core, and of 0.011 inch diameter tin-plated copper wire for the portion of the fusible link 74 forming the outer spiral. TOPHET "C" wire is made of 60% nickel, 15% chromium, and 25% iron. As with the embodiment of FIGS. 2 and 3, when the flaps of the metallic element of FIG. 7 are folded outwardly 180° along those dashed lines, the flaps trap the opposite ends of the spiral-wound fusible link 74. This fusible link 74 is suitable for use in fuses having current ratings of 30 amperes or less.

Figure 6:
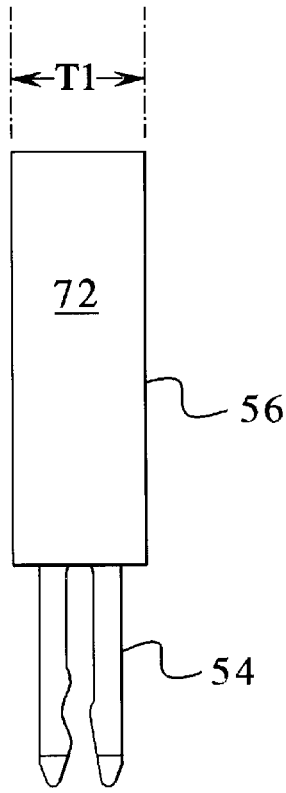
FIG. 6 is a perspective view of two housing halves which, together with the metallic element of the invention, are combined to form one embodiment of a fuse of the invention.

FIG. 3 depicts a perspective view of a blade fuse 50 in accordance with the invention, combining the metallic element 10 of FIG. 2 with a housing 52. In FIG. 3, the terminals 12 and 14 are in line with each other, and parallel to the largest dimension, or front wall with width W3, of the blade fuse housing 52. In contrast, as may be seen in FIG. 6, the terminals 54, one of which is shown, could also be turned 90°, so that the plane of the terminals 54 is parallel with the thickness (T1), i.e., to the side wall 72 of the blade fuse housing.

As may be seen in FIG. 3, this housing 52 includes an insulating tab 58 that extends from the interior of the housing 52. The insulating tab 58 is disposed between opposite ends 60 and 62 of the fusible link 48. The insulating tab 58 acts as an arc barrier.

The metallic element 10 of the invention is formed in a manner where the fuse 50 that includes that element 10 is a so-called "dual use" fuse. What is meant by this is that the resulting fuse 50 can be used with fuseholders having either male or female terminal receiving clips.

Figure 4:
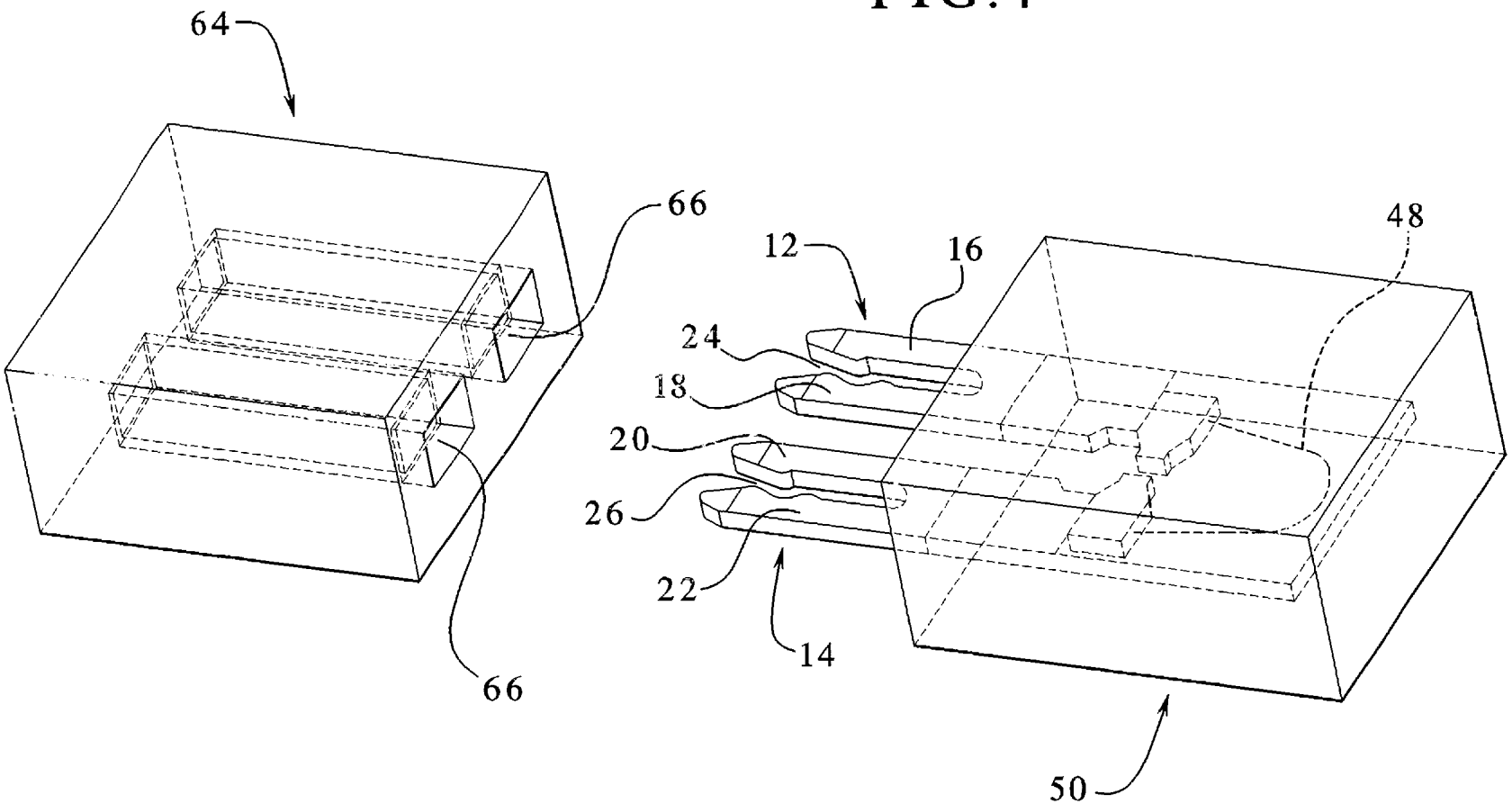
FIG. 4 is a perspective view of the blade fuse shown in FIG. 3, which blade fuse is placed within a fuse block having conventional female terminal receiving clips.
Figure 5:
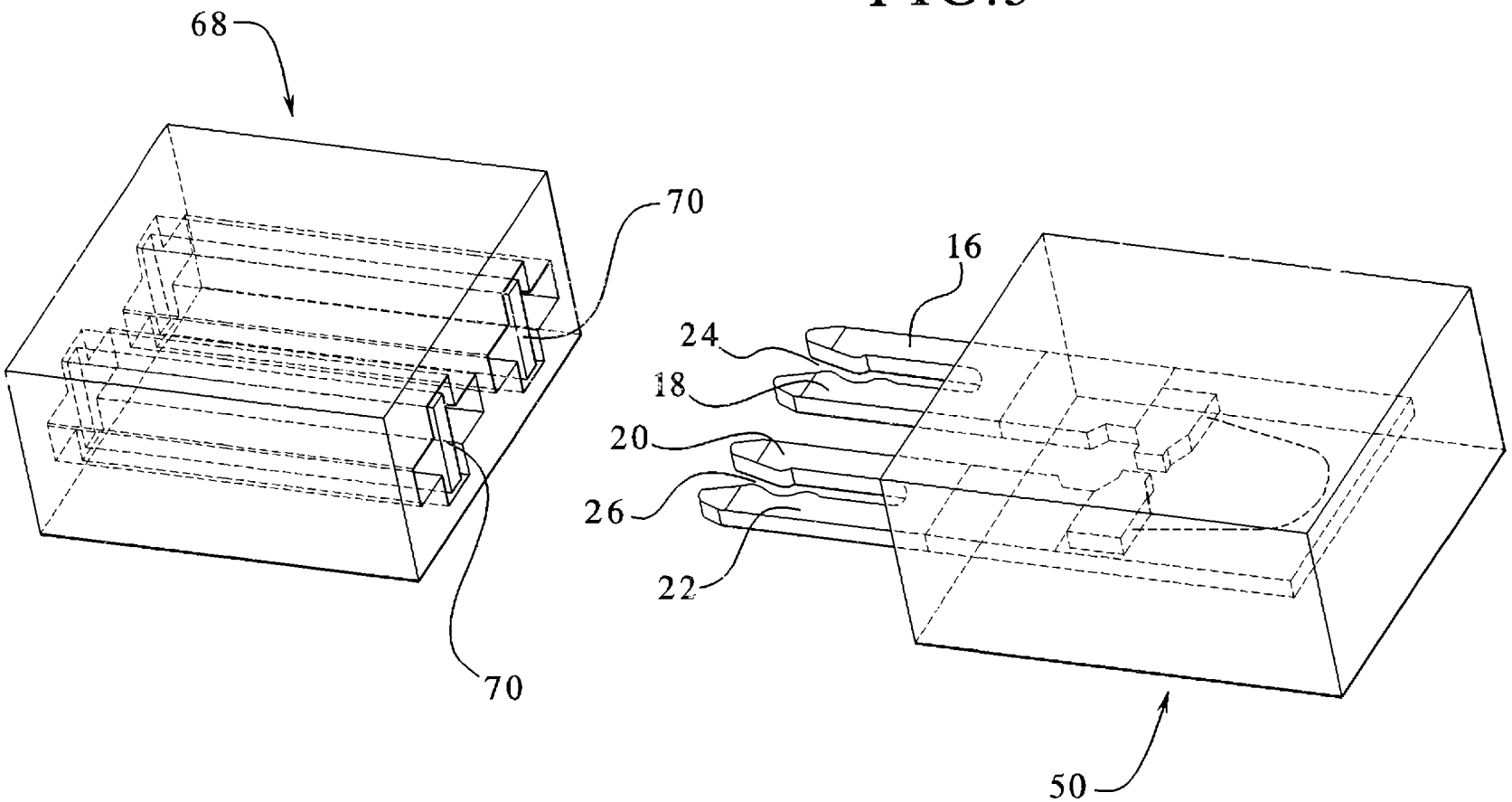
FIG. 5 is a perspective view of the blade fuse shown in FIG. 3, but placed within a fuse block having male terminal receiving clips.

Depicted in FIGS. 4 and 5 is the mounting of this dual use fuse 50 having the novel metallic element 10 in the two types of fuseholders. As may be seen in FIG. 4, when inserted into a fuseholder 64 having female terminal receiving clips 66, the first 16, 20 and second prongs 18, 22 of each of the terminals 12 and 14 cooperatively fit into a corresponding female terminal receiving clip 66. In contrast, when inserted into a fuseholder 68 having male terminal receiving clips 70, the gap 24, 26 between the first 16, 20 and second prongs 18, 22 of each of the fuse's terminals 12 and 14 tightly engage the male terminal receiving clips 70 of the fuseholder 68.

Preferably, the terminal portions 12 and 14 of the metallic element 10 are made of a copper alloy. Preferably, the two terminals 12, 14 and the fusible link 48 comprise three separate pieces.

Figure 9:
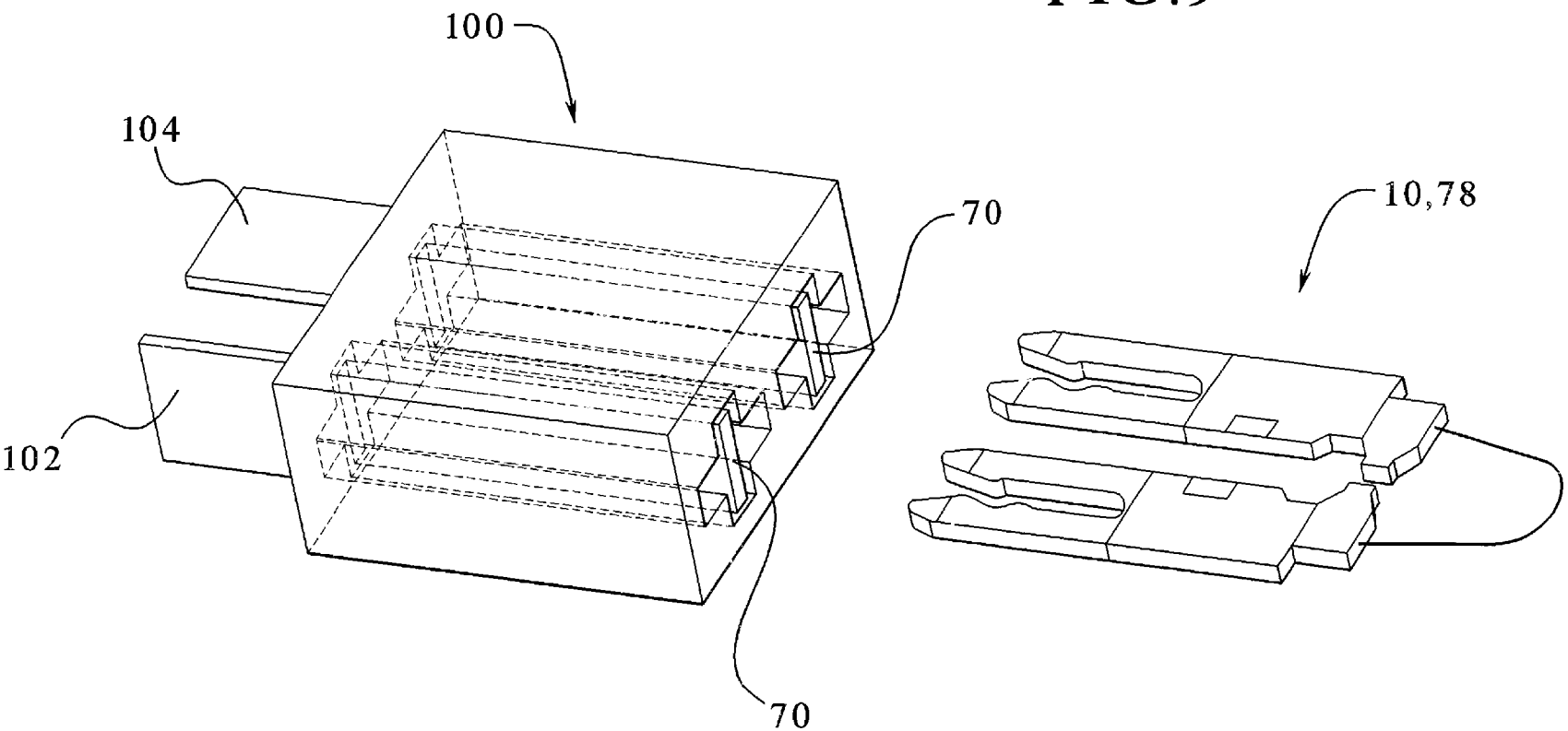
FIG. 9 is a perspective view of one embodiment of a metallic element being used with a diode.

The above description and the FIGURES show the components of the invention being used for a conventional blade fuse with parallel, in-line terminals. It will be understood by those skilled in the art that these components may also be used in other electrical circuits. For example, referring to FIG. 9, any of the metallic elements disclosed herein, e.g., the metallic element 10 discussed above or the metallic element 78 discussed below may be used in a diode 100. The diode 100 has two terminals 102 and 104 oriented at a ninety (90°) degree angle relative to each other. The diode 100 is illustrated having the male receiving clips 70 discussed above in connection with the fuseholder 68 of FIG. 5. Alternatively, the diode employs the female receiving clips 66 discussed above with the fuseholder 64 of FIG. 4. The metallic element 10 includes one of the fusible links 48 or 74 discussed above or the fusible link 76 discussed below.

FIG. 8 shows an embodiment of the invention including yet another kind of fusible link. The fusible link 76 of FIG. 8 is made of a stamping; the resulting metallic element 78 is therefore referred to as a "stamped element design." It is preferably thinner than the terminals to which it is attached. It is attached in a similar manner as the metallic element of FIGS. 2 and 3, except that the flaps are folded outwardly 180° to trap the opposite ends of the fusible link 76. This fusible link 76 is suitable for fuses having current ratings of 10 amperes or more.

It will be appreciated by the above that there are many advantages to the present invention. First, the construction of the invention allows it to be used with fuseblocks having either male or female terminal receiving clips.

Second, when the invention is used with fuseblocks having male terminal receiving clips, the female portion of the novel blade fuse terminal is used. In this way, if the female terminal is damaged due to electrical problems in the circuit being protected by the fuse, the replacement of the female terminal can be simply accommodated by replacement of the blade fuse, rather than by replacement of the terminal receiving clips.

Third, although there are several different types of fuses with female terminals, including the fuses described in U.S. Pat. Nos. 5,581,225, 4,570,147; 4,751,490; 4,869,972; and 4,871,990, their construction is much more complex and costly than the construction of the fuse of the present invention.

Fourth, unlike the present invention, these prior art fuses with female terminals are not "dual use fuses," i.e., they are not adaptable for use fuseholders having both male and female terminal receiving clips.

While the specific embodiments have been illustrated and described, numerous modifications come to mind without significantly departing from the spirit of the invention and the scope of protection is only limited by the scope of the accompanying Claims.

What I claim is:

1. A metallic element for use with a blade fuse, said blade fuse blade being for mounting in a fuseholder, said fuseholder having either male terminal receiving clip, or female terminal receiving clips, said metallic element comprising:

(a) a plurality of terminal portions, each of said terminal portions adapted to secure to either said male and said female terminal receiving clips; and (b) a fusible link secured to each of said terminal portions.

2. The metallic element of claim 1, wherein each of said terminal portions define spaced apart first and second prongs disposed so as to form a gap, said gap being shaped and sized in a manner that will ensure secure engagement of said first and second prongs with male terminal blade-receiving clips.

3. The metallic elements claim 1, wherein each of said terminal portions define first and second prongs that cooperatively fit into one of said female terminal receiving clips.

4. The element of claim 1, wherein said terminal portions are made of a copper alloy.

5. The element of claim 2, wherein said terminal portions are made of a copper alloy.

6. The element of claim 3, wherein said terminal portions are made of a copper alloy.

7. The metallic element of claim 1, wherein said terminal portions and said fusible link comprise three separate pieces.

8. A blade fuse including a metallic element, said blade fuse being for mounting in a fuseholder, said fuseholder having either male terminal receiving clips, or female terminal receiving clips, said blade fuse comprising:

(a) a plurality of terminal portions, wherein each of said terminal portions includes a first prong and a second prong, said first and second prongs of each of said terminal portions adapted to engage either of said male and said female terminal receiving clips;

(b) a fusible link secured to each of said terminal portions; and (c) a housing enclosing at least a part of said metallic element.

9. The blade fuse of claim 8, wherein said spaced apart first and second prongs together form a gap between them, said gap being shaped and sized in a manner that will ensure secure engagement of said first and second prongs with male terminal blade-receiving clips.

10. The blade fuse of claim 8, wherein said first and second prongs of each of said terminal portions cooperatively fit into a corresponding female terminal receiving clip.

11. The blade fuse of claim 8, wherein said terminal portions are made of a copper alloy.

12. The blade fuse of claim 9, wherein said terminal portions are made of a copper alloy.

13. The blade fuse of claim 10, wherein said terminal portions are made of a copper alloy.

14. The blade fuse of claim 8, wherein said terminal portions and said fusible link comprise three separate pieces.

15. A metallic element for use with an electrical component, said metallic element comprising:

(a) a plurality of terminal portions, each of said terminal portions adapted to engage either one of a male receiving clip and a female receiving clip defined by said electrical component; and (b) a fusible link secured to each of said terminal portions.

16. The metallic element of claim 15, wherein each of said terminal portions define spaced apart first and second prongs disposed so as to form a gap between them, said gap being shaped and sized in a manner that will ensure secure engagement of said first and second prongs with male terminal blade-receiving clips.

17. The metallic element of claim 15, wherein each of said terminal portions define first and second prongs that cooperatively fit into one of said corresponding female terminal receiving clips.

18. The metallic element of claim 15, wherein said terminal portions are made of a copper alloy.

19. The metallic element of claim 16, wherein said terminal portions are made of a copper alloy.

20. The metallic element of claim 17, wherein said terminal portions are made of a copper alloy.

21. The metallic element of claim 15, wherein said terminal portions and said fusible link comprise three separate pieces.

22. The metallic element of claim 15, wherein terminal portions are oriented at a ninety (90°) degree angle relative to each other.

23. The metallic element of claim 15, wherein said electrical component is a diode.

* * * * *